US005151568A

United States Patent [19]

Rippley

[11] Patent Number: 5,151,568

[45] Date of Patent: Sep. 29, 1992

[54] DISPOSABLE MICROWAVE COOKING UTENSIL

[76] Inventor: Martsey D. Rippley, 1500 N. Park Dr., Unit 140, Fort Worth, Tex. 76102

[21] Appl. No.: 616,429

[22] Filed: Nov. 21, 1990

[51] Int. Cl.[5] ..... H05B 6/60

[52] U.S. Cl. ..... 219/10.55 E; 426/113; 426/118; 426/234; 426/243; 99/DIG. 14

[58] Field of Search ..... 219/10.55 E, 10.55 F; 426/107, 243, 234, 113, 114, 115, 122, 123, 118; 206/619, 524.3, 205; 220/454, 458; 99/DIG. 14

[56] References Cited

U.S. PATENT DOCUMENTS

| | | | |
|---|---|---|---|
| 3,424,596 | 1/1969 | Sullivan | 426/113 |
| 3,640,209 | 2/1972 | Wilson | 426/113 |
| 3,863,832 | 2/1975 | Gordon et al. | 426/113 |
| 3,994,212 | 11/1976 | Wong | 219/10.55 E |
| 4,121,510 | 10/1978 | Frederick | 219/10.55 E |
| 4,190,757 | 2/1980 | Turpin et al. | 219/10.55 E |
| 4,275,811 | 6/1981 | Miller | 206/205 |
| 4,529,089 | 7/1985 | Gasbarra et al. | 426/113 |
| 4,935,592 | 6/1990 | Oppenheimer | 219/10.55 E |
| 4,939,332 | 7/1990 | Hahn | 219/10.55 E |
| 4,943,439 | 7/1990 | Andreas et al. | 219/10.55 E |

*Primary Examiner*—Bruce A. Reynolds
*Assistant Examiner*—Tuan V. To
*Attorney, Agent, or Firm*—Geoffrey A. Mantooth

[57] ABSTRACT

The cooking utensil has a container formed by bottom and side walls. The bottom and side walls form a cavity within the container. The corrugated wall is located inside of the container cavity. The corrugated wall has openings therethrough located in hollows of the corrugations. A support structure located in the cavity supports the corrugated wall above the bottom wall. Absorbent material is located inside of the cavity between the bottom wall and the corrugated wall. The absorbent material absorbs and retains liquids from foods that drain through the openings in the corrugated wall, thereby preventing spillage of hot grease out of the container. A cover is provided to cover the container cavity during cooking.

8 Claims, 1 Drawing Sheet

DISPOSABLE MICROWAVE COOKING UTENSIL

FIELD OF THE INVENTION

The present invention relates to utensils for cooking food in microwave ovens.

BACKGROUND OF THE INVENTION

Microwave ovens are useful for, among other things, cooking small amounts of food quickly. A microwave oven has a cavity therein, with a tray or a shelf for placing food thereon. The oven has a door for allowing access to the interior.

When the oven is in use, the cavity is irradiated by electromagnetic energy. As the food is irradiated, it heats up and splatters if not covered. Splattering is particularly a problem with greasy foods such as bacon. In addition to splattering, bacon produces large amounts of hot grease that pools around the bacon. In order to prevent the bacon from "swimming" in the hot grease, one prior art method of cooking bacon utilizes sheets of paper towel located above and below the bacon. The paper towel absorbs the grease from the bacon. After cooking, the grease-sodden paper towel must be disposed of. This poses some degree of danger because the hot grease is exposed to the touch, wherein a cook handling the plate and paper towel can be easily burned. In addition, this prior art method is messy because the plate must be cleaned of grease after using.

There is in the prior art a microwave ceramic cooking utensil that is somewhat suitable for cooking bacon. The prior art utensil is a shallow pan having corrugations on the bottom of the pan. Bacon is laid on top of the corrugations so as to be above the liquid grease that pools at the bottom of the corrugations during cooking. The hot liquid grease, which may be splattering, sloshes around in the bottom of the pan, posing a danger of burning and also presenting a disposal problem.

SUMMARY OF THE INVENTION

It is an object of the present invention to provide a cooking utensil in which greasy foods, such as bacon, can be cooked in a microwave oven, which utensil safely retains the resulting grease for effective disposal.

The cooking utensil of the present invention includes container means, corrugated wall means, support means and absorbing means. The container means has a bottom wall and side walls. The side walls are coupled to the bottom wall so as to form a cavity inside of the container means. The corrugated wall means is located inside the cavity. The corrugated wall means has alternating ridges and hollows. The corrugated wall means has openings therethrough, with the openings being located in the hollows. The corrugated wall means is adapted to support food thereon. The support means supports the corrugated wall means above the bottom wall of the container means such that there is a space between the corrugated wall means and the container means bottom wall. The support means is coupled to the container means. The absorbing means absorbs liquids produced by foods that are cooking on the corrugated wall means. The absorbing means is located in the space between the corrugated wall means and the bottom wall. The absorbing means retains the liquids within the container means and within the space between the corrugated wall means and the bottom wall. The cooking utensil is made of material suitable for use in a microwave oven.

In one aspect, the cooking utensil further includes cover means for covering the container means cavity. The cover means has an edge that is coupled to a portion of the side walls. In another aspect, the container means has a lip wall that extends outwardly from the upper edge of the side walls. The lip wall is suitable for grasping the container means. In another aspect, the absorbing means is made of cellulose or paper material. In still another aspect, the container means and the corrugated wall means are made of stiff paperboard.

With the cooking utensil of the present invention, hot liquids such as grease are drained away from the food through the openings in the corrugated wall means. The hot liquids are absorbed by the absorbing means located below the corrugated wall means. The absorbing means retains the hot liquids inside of the container, eliminating spillage and splattering of the hot liquids and any possibility of burns caused by those liquids. The container and the corrugated wall means are made of stiff paper board and the absorbing means is made of cellulose or other absorbent materials. The hot liquids that are retained inside of the cooking utensil can be safely disposed of by disposing of the entire cooking utensil.

DESCRIPTION OF PREFERRED EMBODIMENT

Figure 1:
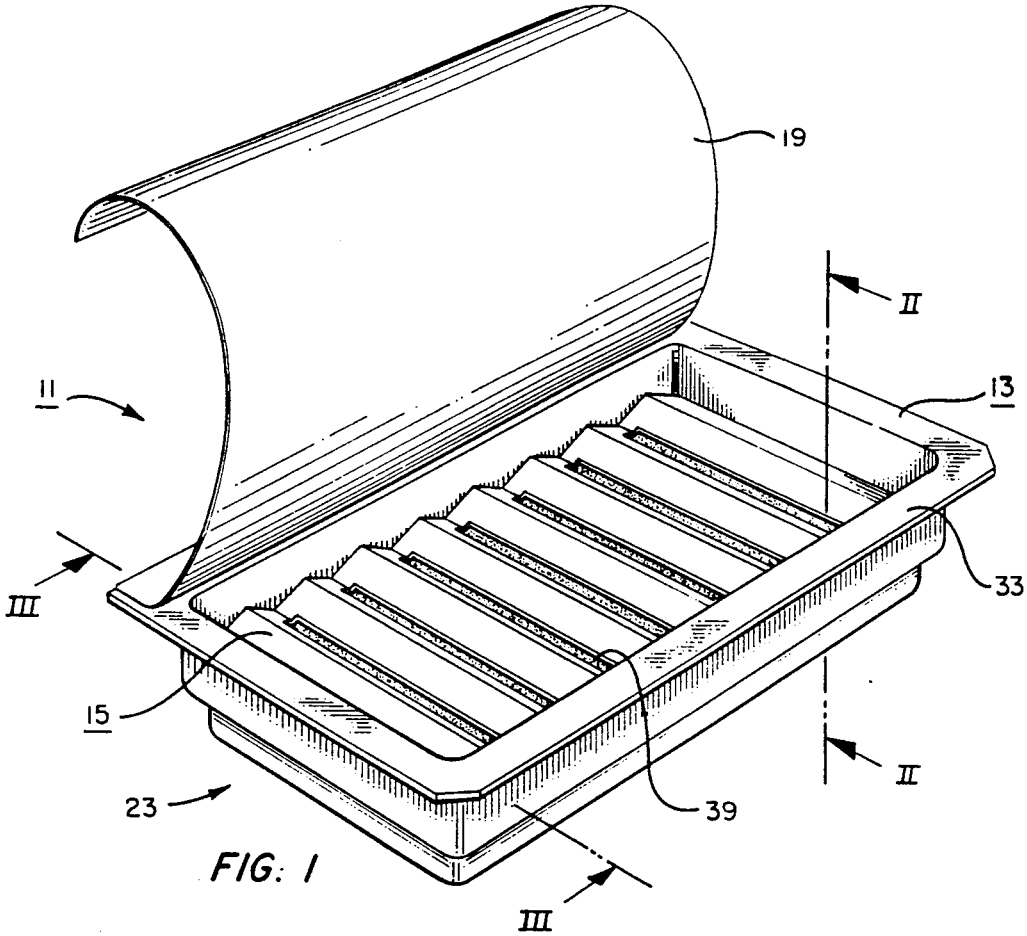
FIG. 1 is an isometric view of the cooking utensil of the present invention, in accordance with a preferred embodiment.

In FIG. 1, there is shown an isometric view of the cooking utensil of the present invention, in accordance with a preferred embodiment. The cooking utensil 11 is used to cook foods such as bacon in a microwave oven. After use, the cooking utensil may be thrown away or otherwise disposed of.

Referring to the FIGS., the cooking utensil of the present invention includes a container 13, a corrugated wall 15, absorbent material 17 and a cover 19.

The container 13 is pan shaped having a flat rectangular bottom wall 21. A side wall 23 extends perpendicularly from the edges of the bottom wall 21. The side wall also extends around the circumference of the bottom wall. The side wall 23 is divided into a lower portion 25 and an upper portion 27. The lower portion 25 extends up from the bottom wall 21. At the upper edge of the lower portion 25 is a shoulder formed by a support wall 29 extending outwardly from said lower portion. The support wall 29 is perpendicular to the lower portion 25. At the outer edge of the support wall 29 is the upper portion 27 that extends upwardly and that is perpendicular to the support wall. The bottom wall 21 and the side wall 23 form a cavity 31 inside of the container 13. The container 13 also has a lip wall 33 that extends outwardly from the upper edge of the upper portion 27. The lip wall 33 forms a handle that extends around the container and that is suitable for grasping. Thus, a cook can pick up the container 13 by grasping the lip wall 33.

Figure 3:
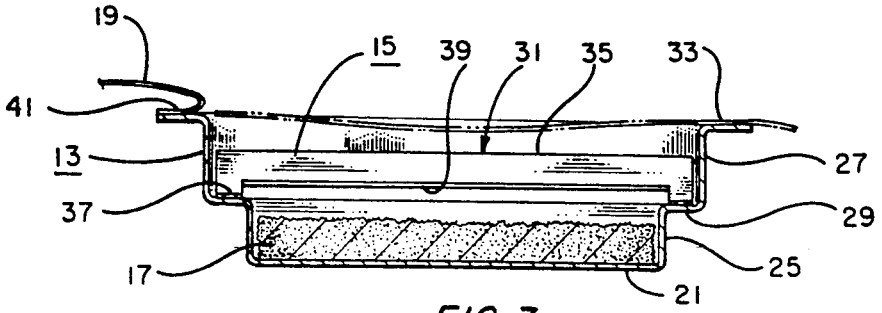
FIG. 3 is a cross-sectional view of the cooking utensil, taken through lines III—III of FIG. 1.

The corrugated wall 15 has plural alternating ridges 35 and hollows 37. The corrugated wall 15 has long narrow openings 39 therethrough, which openings are located in the hollows 37. As shown in FIGS. 1 and 3, the openings 39 extend to near the edges of the corrugated wall 15, leaving the edge portions of the corrugated wall intact so as to bear on the container support wall 29.

Figure 2:
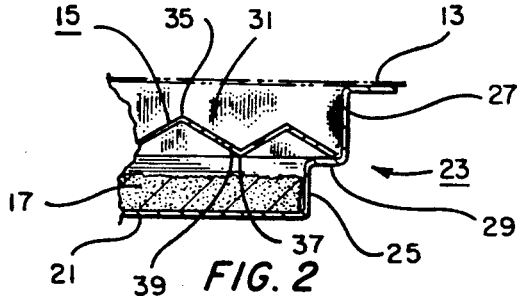
FIG. 2 is a cross-sectional view of the cooking utensil, taken through lines II—II of FIG. 1.

The corrugated wall 15 is located within the container cavity 31 so as to bear on the support wall 29 as shown in FIGS. 2 and 3. Because of the corrugations, it is the edge portions of the hollows 37 that actually bear on the support wall 29. The ridges 35 are located above the support wall. The corrugated wall 15 is sized so as to extend to all portions of the side wall upper portion 27. The upper portion 27 of the side wall extends up past the corrugated wall 15, so that food placed on the corrugated wall will be within the container cavity 31. With the corrugated wall installed inside the container, the corrugated wall 15 is generally parallel to the bottom wall 21. The support wall 29 supports the corrugated wall 15 above the bottom wall 21 so as to form a space therebetween.

The container and the corrugated wall 15 are both made of stiff paperboard. Paperboard is economical enough to enable the cooking utensil to be disposed of after use. Paperboard is also easily formed into the desired shape. For example, the container could be molded from pulp products using conventional pulp fiber molding techniques. In addition, the paperboard is somewhat resistant to liquids such as grease, so that liquids produced during the cooking process are retained inside of the cooking utensil and not leaked out. Alternatively, the container and corrugated wall could be made of a microwavable plastic.

The absorbent media 17 is located within the container cavity 31 in the space between the corrugated wall 15 and the bottom wall 21. The absorbent material 17 absorbs and retains the liquids, such as grease, produced by cooking. Once liquids are absorbed by the absorbent material 17, there is no spillage of the liquids outside of the container 13. The absorbent material 17 is made of a mass of material such as cellulose. Cellulose is microwavable and absorbs and retains the liquids within its mass. I have also found that paper towels, either folded in layers or wadded up, work well. In addition, a cotton pad or an oil-absorbing towel also work well as the absorbent material 17. The absorbent material 17 bears on the bottom wall 21 of the container 13 and extends to all portions of the side wall lower portion 25 so as to catch all of the liquids draining down.

The cover 19 is, in the preferred embodiment, a sheet of absorbent paper. The cover 19 is rectangular in shape and has one edge portion 41 coupled to the lip wall 33 of the container 33 along one side. Suitable adhesive or fasteners is used to couple the cover to the container. The cover 19 can be moved between the open position, wherein the corrugated wall 15 is exposed (see FIG. 3), to the closed position, wherein the corrugated wall is covered. In the closed position, the cover 19 is supported above the corrugated wall by the lip wall 33 of the container. To prevent sagging, the cover 19 can be sized so as to extend over the lip wall 33 as shown in FIG. 3.

To use the cooking utensil 11 of the present invention, the cover 19 is opened by folding it over its coupled edge 41. Food is then placed on the corrugated wall 15. Preferably, the food is placed so as to be oriented perpendicularly to the direction of the ridges 35, so that the food is supported by the ridges above the hollows 37. The cover 19 is then closed and the utensil and food are placed in the microwave oven.

During cooking, foods such as bacon produce large amounts of grease and other liquids. The grease is drained away from the bacon by flowing into the hollows 37 of the corrugated wall 15. The grease then flows through the openings 39 and drips onto the absorbent material 17. The absorbent material 17 retains the hot grease below the corrugated wall 15. Spattered grease is retained inside of the cooking utensil by the cover 19 and also by the corrugated wall 15.

After cooking, the cooking utensil is removed from the oven. The lip wall 33 is used to grasp the edges of the cooking utensil. Because the container is made of paperboard, it can be touched with bare hands without fear of burning. Therefore, there is no need for clumsy hot pads in lifting the container. Because the grease is retained by the absorbent material 17 inside of the container, there is no spilling or danger of being burned by the hot grease. After the food is removed, the used cooking utensil 11 can be thrown away. This eliminates the hazardous removal or draining of hot grease from the container.

Although the cooking utensil of the present invention has been described with a support wall 29 for supporting the corrugated wall 15, other support means can be used. For exampled, support means can be small blocks that are coupled to the inside surface of the side wall. The corrugated wall would bear on the block so as to be located above the absorbent material. Furthermore, the corrugated wall can either bear on the support means or be coupled thereto with suitable adhesive.

Although the cooking utensil of the present invention has been described with a flat paper cover 19, other types of covers can be used. For example, the cover may be made of a transparent material such as plastic, to enable the cook to view the food inside of the container. The plastic would be of the type suitable for use in a microwave oven. In addition, the cover need not be flat, but could instead be shaped like an inverted pan. Such a cover would have side walls and a top wall and have more depth than a flat cover. A deeper cover would allow the container to be somewhat shallower, so that food could project up beyond the container.

The foregoing disclosure and the showings made in the drawings are merely illustrative of the principles of this invention and are not to be interpreted in a limiting sense.

I claim:

1. A disposable microwave cooking utensil, comprising:

a) container means having a bottom wall and side walls, said side walls being coupled to said bottom wall so as to form a cavity inside of said container means;

b) corrugated wall means located in said cavity of said container means, said corrugated wall means having alternating ridges and hollows, said corrugated wall means having openings therethrough, said openings being located in said hollows, said corrugated wall means being adapted to support food thereon;

c) support means for supporting said corrugated wall means above the bottom wall of said container means such that there is a space between said container wall means and said container means bottom wall, said support means being coupled to said container means;

d) absorbing means for absorbing liquids produced by foods cooking on said corrugated wall means, said absorbing means being located in said space between said corrugated wall means and said bottom wall, said absorbing means being exposed to said openings in said hollows of said corrugated wall means, said absorbing means retaining said liquids within said container means and within said space between said corrugated wall means and said bottom wall;

e) said container means, corrugated wall means, support means and absorbing means being made of materials suitable for use in microwave ovens.

2. The cooking utensil of claim 1 further comprising cover means for covering said container means cavity, said cover means having an edge that is coupled to a portion of said side walls, said cover means capable of being manipulated between open and closed positions.

3. The cooking utensil of claim 2 wherein said absorbing means is made of cellulose or absorbent paper material.

4. The cooking utensil of claim 1 wherein said absorbing means is made of cellulose or absorbent paper material.

5. The cooking utensil of claim 1 wherein said container means has a lip wall extending outwardly from an upper edge of said side walls, said lip wall being suitable for grasping said container means.

6. The cooking utensil of claim 5 further comprising cover means for covering said container means cavity, said cover means having an edge portion that is coupled to a portion of said lip wall, said cover means being capable of being manipulated between open and closed positions.

7. A disposable microwave cooking utensil, comprising:

a) container means having a flat bottom wall and side walls, said side walls being coupled to said bottom wall so as to extend from said bottom wall, said side walls and bottom wall forming a cavity inside of said container means, said container means having a lip wall extending outwardly from an upper edge portion of said side walls, said lip wall forming a handle means for grasping said container means;

b) corrugated wall means for supporting food during cooking, said corrugated wall means having alternating ridges and hollows, said hollows having a length, said corrugated wall means having openings therethrough, said openings being located along said hollows and being elongated so as to extend for most of the length of said hollows;

c) support means for supporting said corrugated wall means inside of said container means cavity and above said bottom wall such that there is a space between said corrugated wall means and said bottom wall, said support means being coupled to said container means;

d) absorbing means for absorbing liquids produced by foods cooking on said corrugated wall means, said absorbing means being located in said space between said corrugated wall means and said bottom wall, said absorbing means being exposed to said openings in said hollows of said corrugated wall means, said absorbing means retaining said liquids within said container means and within said space between said corrugated wall means and said bottom wall;

e) said container means and said corrugated wall means being made of a stiff paperboard material, said absorbing means being made of a mass of cellulose or absorbent paper material;

f) cover means for covering said container means cavity, said cover means having an edge that is coupled to a portion of said lip wall, said cover means being capable of being manipulated between open and closed positions.

8. The cooking utensil of claim 7 wherein said support means comprises a shoulder located on said side walls, said hollows of said corrugated wall means having edge portions that bear on said shoulder.

* * * * *